US011414821B2

(12) United States Patent
Yu et al.

(10) Patent No.: US 11,414,821 B2
(45) Date of Patent: Aug. 16, 2022

(54) EXPANDABLE MODULAR ENERGY-DISSIPATION PROTECTION NET UNIT GROUP AND PROTECTION NET SYSTEM FORMED BY THE SAME

(71) Applicant: Southwest Jiaotong University, Chengdu (CN)

(72) Inventors: Zhixiang Yu, Chengdu (CN); Liru Luo, Chengdu (CN); Yuntao Jin, Chengdu (CN); Liping Guo, Chengdu (CN); Hu Xu, Chengdu (CN); Xin Qi, Chengdu (CN); Lei Zhao, Chengdu (CN); Shichun Zhao, Chengdu (CN)

(73) Assignee: SOUTHWEST JIAOTONG UNIVERSITY, Chengdu (CN)

( * ) Notice: Subject to any disclaimer, the term of this patent is extended or adjusted under 35 U.S.C. 154(b) by 190 days.

(21) Appl. No.: 17/009,783

(22) Filed: Sep. 2, 2020

(65) Prior Publication Data

US 2021/0348345 A1 Nov. 11, 2021

(30) Foreign Application Priority Data

May 5, 2020 (CN) ..... 202010369545.5

(51) Int. Cl.
*E01F 7/04* (2006.01)
*E04H 17/02* (2006.01)

(52) U.S. Cl.
CPC ..... *E01F 7/045* (2013.01); *E04H 17/02* (2013.01)

(58) Field of Classification Search
CPC ..... E01F 7/04; E01F 7/045; E21D 11/152; E04H 17/02; E04H 17/05
See application file for complete search history.

(56) References Cited

U.S. PATENT DOCUMENTS 546,569 A * 9/1895 Whitmore ..... E04H 17/02 256/11
560,562 A * 5/1896 Albert ..... E04H 17/02 256/38

(Continued)

FOREIGN PATENT DOCUMENTS

CN 111074802 A * 4/2020
CN 111719449 A * 9/2020

(Continued)

*Primary Examiner* — Jonathan P Masinick
(74) *Attorney, Agent, or Firm* — Bayramoglu Law Offices LLC

(57) ABSTRACT

An expandable modular energy-dissipation protection net unit group includes support columns each provided at each of two ends of each support column with a first horizontal longitudinal rotation reversing device on the left side, a second horizontal longitudinal rotation reversing device on the right side and a transverse rotation reversing device on the bottom; a transverse endless support rope, a longitudinal endless support rope and connectors. The transverse endless support rope is wound on the transverse rotation reversing device. The longitudinal endless support rope is wound on the first horizontal longitudinal rotation reversing device and the second horizontal longitudinal rotation reversing device adjacent. A metal net panel is tied by the plurality of connecting members and hung on the transverse endless support rope and the longitudinal endless support rope.

20 Claims, 3 Drawing Sheets

(56) References Cited

U.S. PATENT DOCUMENTS

| | | | | | |
|---|---|---|---|---|---|
| 5,186,438 | A * | 2/1993 | Cross | E01F 9/669 403/294 |
| 5,395,105 | A * | 3/1995 | Thommen, Jr. | E01F 7/045 256/12.5 |
| 5,435,524 | A * | 7/1995 | Ingram | E01F 7/04 256/12.5 |
| 5,961,099 | A * | 10/1999 | Thommen, Jr. | E01F 7/04 256/45 |
| 2018/0274618 | A1* | 9/2018 | Ng | F16F 13/005 |

FOREIGN PATENT DOCUMENTS

| | | | | | |
|---|---|---|---|---|---|
| DE | 1057157 | B * | 5/1959 | | |
| DE | 2107233 | A1 * | 8/1971 | | |
| DE | 2428074 | A1 * | 12/1975 | | |
| DE | 102009029892 | A1 * | 9/2011 | | E01F 8/00 |
| EP | 2711461 | A1 * | 3/2014 | | E01F 7/045 |
| FR | 2695177 | A1 * | 3/1994 | | E01F 7/045 |
| JP | 2005320696 | A * | 11/2005 | | |
| JP | 2011111808 | A * | 6/2011 | | E01F 7/045 |
| KR | 20180059077 | A * | 6/2018 | | |
| WO | WO-2010001478 | A1 * | 1/2010 | | E01F 7/045 |

* cited by examiner

EXPANDABLE MODULAR ENERGY-DISSIPATION PROTECTION NET UNIT GROUP AND PROTECTION NET SYSTEM FORMED BY THE SAME

CROSS-REFERENCE TO RELATED APPLICATION

This application is based upon and claims priority to Chinese Patent Application No. 202010369545.5, filed on May 5, 2020, the entire contents of which are incorporated herein by reference.

TECHNICAL FIELD

The invention relates to the field of slope geological disaster protection, in particular to an expandable modular energy-dissipation protection net unit group and a protection net system formed by the same, which is suitable for passive protection of collapse and rockfall in the fields of transportation, land, mines, hydropower, urban construction, military affairs and the like.

BACKGROUND

China is a mountainous country confronted with severe situation of geological disaster prevention such as collapse and rockfall. Many traffic trunk lines under construction and to be built, including the strategic project of the proposed Sichuan-Tibet line, are facing geological disaster risks. The other areas including land, mines, hydropower, urban construction, military, etc., are in urgent need for high-efficiency protection.

The occurrence of rockfall and collapse is sudden and unpredictable, which requires efficient protection system performance as well as economical and rapid protection construction and operation maintenance to ensure protection safety.

The traditional passive flexible protection system is built on the mountain and is anchored on the slope surface by linearly-arranged support ropes tying and hanging the metal net panels and passing through multiple inter-column interception units. There are many anchoring points, and the anchoring construction is heavy and difficult. Moreover, the traditional passive flexible protection net system has complex connection and strong correlation between members, which leads to strong system integrity. Therefore, the system is susceptible to systematic damage after interception, requiring large maintenance and renewal workload, and the construction is difficult. In addition, in the traditional passive protection net system, support ropes and energy dissipaters connected to the support ropes are the main energy-dissipation components of the system. However, the support ropes has a long slip path, and the protection units between columns has many interference factors on the slip of the support ropes, resulting in low energy dissipation efficiency. On the whole, the protection ability is low and the protection effect is not ideal.

SUMMARY

In view of the above problems, an object of the present invention is to provide a modular-unit distributed energy-dissipation protection net system and an installation method thereof, which has the characteristics of short deformation path, high energy-dissipation efficiency, few anchoring points, independent distributed energy dissipation, independent disassembly and assembly, etc., and can solve the problems in an existing passive flexible protection system that the construction of anchor points of support ropes is difficult and requires heavy workload, protection units between columns cannot function independently and cannot be replaced independently, and the protection system cannot be expanded arbitrarily. According to the invention, modular units are adopted as a protection structure, and the invention has high economy, recoverability and expandability.

In order to achieve the above object, the invention adopts the following technical solution:

An expandable modular energy-dissipation protection net unit group includes:

support columns each provided at each of its two ends with a first horizontal longitudinal rotation reversing device on the left side, a second horizontal longitudinal rotation reversing device on the right side and a transverse rotation reversing device on the bottom;

a transverse endless support rope wound on the transverse rotation reversing devices located at two ends of the support column;

a longitudinal endless support rope wound on adjacent first and second horizontal longitudinal rotation reversing devices; and connecting members by which a metal net panel is tied and hung on the transverse endless support rope and the longitudinal endless support rope.

Further, the transverse endless support rope and the longitudinal endless support rope are each formed by a plurality of steel wire ropes in parallel, and include a side A at a lower side and a side B at an upper side. The connecting members are tied and hung on the side A, and first energy dissipaters are connected to the side B.

Further, the metal net panel is woven by steel wire ropes or steel wire rings.

Further, the expandable modular energy-dissipation protection net unit group further includes:

a stabilizing and anchoring steel wire rope anchored on a slope surface at one end and connected to the support column at the other end.

Further, second energy dissipaters are connected to the stabilizing and anchoring steel wire rope.

Further, the horizontal longitudinal rotation reversing device, the second horizontal longitudinal rotation reversing device and the transverse rotation reversing device are fixed pulleys.

Further, the first and second energy dissipaters are traction energy dissipaters, and the energy-dissipation capacity, quantity and arrangement of the first and second energy dissipaters are adjustable.

On the other hand, in order to achieve the above object, the present invention also adopts the following technical solution:

A modular-unit uniformly-distributed energy-dissipation protection net system includes a plurality of expandable modular unit groups as mentioned above, and adjacent expandable modular unit groups share a support column.

Further, the modular-unit protection net system further includes:

segmented longitudinal tethers by which adjacent support columns are connected.

On the other hand, in order to achieve the above object, the present invention also adopts the following technical solution:

An installation method of the modular-unit uniformly-distributed energy-dissipation protection net system as mentioned above includes the following construction steps:

a. foundation of support columns is constructed according to an overall arrangement of the system, and then the support columns are installed, wherein the support columns may be laid flat on a slope surface with the bottom thereof hinged;

b. a horizontal longitudinal rotation reversing device, a second horizontal longitudinal rotation reversing device and a transverse rotation reversing device are installed at each of two ends of each support column;

c. steel wire ropes are made to pass around the horizontal longitudinal rotation reversing device, the second horizontal longitudinal rotation reversing device and the transverse rotation reversing device, and then are connected to form a transverse endless support rope and a longitudinal endless support rope of a modular unit;

d. a metal net panel of the modular unit is installed and is connected with the transverse endless support rope and the longitudinal endless support rope by connecting members;

e. segmented longitudinal tethers between columns of modular units are installed;

f. stabilizing and anchoring steel wire ropes for support columns are installed without anchoring;

g. cable wind ropes for temporary construction are installed at the ends of the support columns, the support columns are pulled up from the ground by pulling the cable wind ropes using a hoisting apparatus until bodies of the support columns and the slope surface reach an inclination angle and posture specified by the design, and the system is temporarily fixed by the cable wind ropes;

h. the longitudinal tethers are tensioned, and tensile steel wire ropes and the lateral stabilizing and anchoring steel wire ropes for the support columns are tensioned and anchored on the ground; and i. the cable wind ropes for temporary fixing are removed to complete the installation.

Compared with the prior art, the invention has the following beneficial effects:

(1) The metal net panel is tied and hung by endless support ropes arranged in vertical and horizontal directions between columns, which replace the longitudinal upper and lower support ropes pulled through integrally in the traditional passive net system, thus leading to a shortened sliding path and reduced tension loss of the longitudinal support ropes and improving the energy-dissipation capacity of the longitudinal support ropes;

(2) The energy dissipation of the endless support ropes functioning independently in each modular unit is limited within one energy-dissipation unit, and each modular unit dissipates energy independently and functions independently, thus avoiding associated damage of units between columns during operation of the pulled-through longitudinal support ropes in the traditional technology and improving the protection effect of the system;

(3) The energy-dissipation capacity of the units between columns is further improved by adding the transverse endless support rope;

(4) Each unit of the system functions independently, which is convenient for replacement and maintenance, and avoids the problem of large-area damage caused by the strong correlation of the whole system during operation of the traditional protection net system;

(5) The energy-dissipation capacity of each modular unit can be arbitrarily combined to realize the non-segmented continuous construction of the flexible protection system, which solves the problem that the traditional protection net system must be set in segments, and the interception and protection length can be arbitrarily expanded according to the protection requirements; and (6) By arranging the endless support ropes, anchor points arranged throughout the support ropes are greatly reduced, and the support ropes and the support columns in each modular unit form a self-balancing constraint, thus saving the material cost and reducing the construction difficulty.

BRIEF DESCRIPTION OF THE DRAWINGS

In order to more clearly illustrate the embodiments of the present invention or the technical solution in the prior art, the drawings to be used in the description of the embodiments or the prior art will be briefly described below. Obviously, the drawings in the following description are some embodiments of the present invention, and other drawings can be obtained according to these drawings by those skilled in the art without creative effort.

Figure 1:
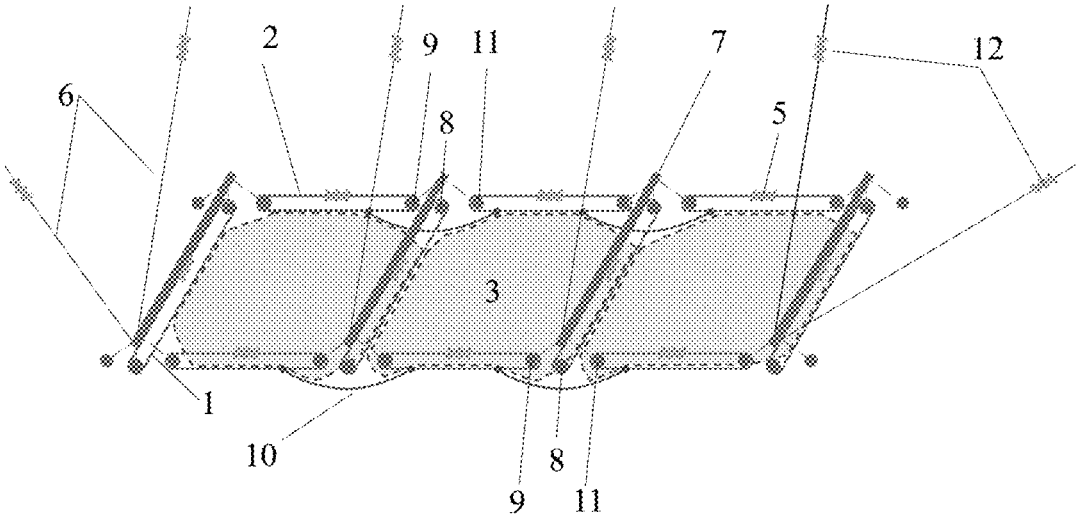
FIG. 1 is a schematic diagram showing an overall arrangement of the system of the present invention.

In the above drawings, the names of the parts corresponding to the reference numerals are as follows:

1—transverse endless support rope; 2—longitudinal endless support rope; 3—metal net panel; 4—connecting member; 5—first energy dissipater; 6—stabilizing and anchoring steel wire rope; 7—support column; 8—transverse rotation reversing device; 9—first horizontal longitudinal rotation reversing device; 10—segmented longitudinal tether; 11—second horizontal longitudinal rotation reversing device; and 12—second energy dissipater.

DETAILED DESCRIPTION OF THE EMBODIMENTS

In order to make the object, technical solution and advantages of the embodiments of the present invention more clear, the technical solution of the embodiments of the present invention will be described clearly and completely below with reference to the drawings in the embodiments of the present invention. Obviously, the described embodiments are only a part of, but not all of the embodiments of the present invention. Based on the embodiments of the present invention, all other embodiments obtained by those of ordinary skill in the art without creative effort are within the scope of protection of the present invention.

Figure 2:
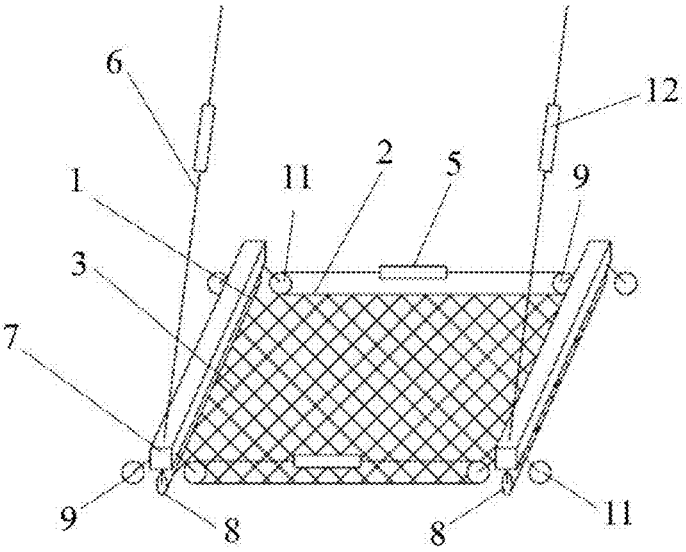
FIG. 2 is a schematic diagram showing arrangement of a modular unit of the present invention.
Figure 3:
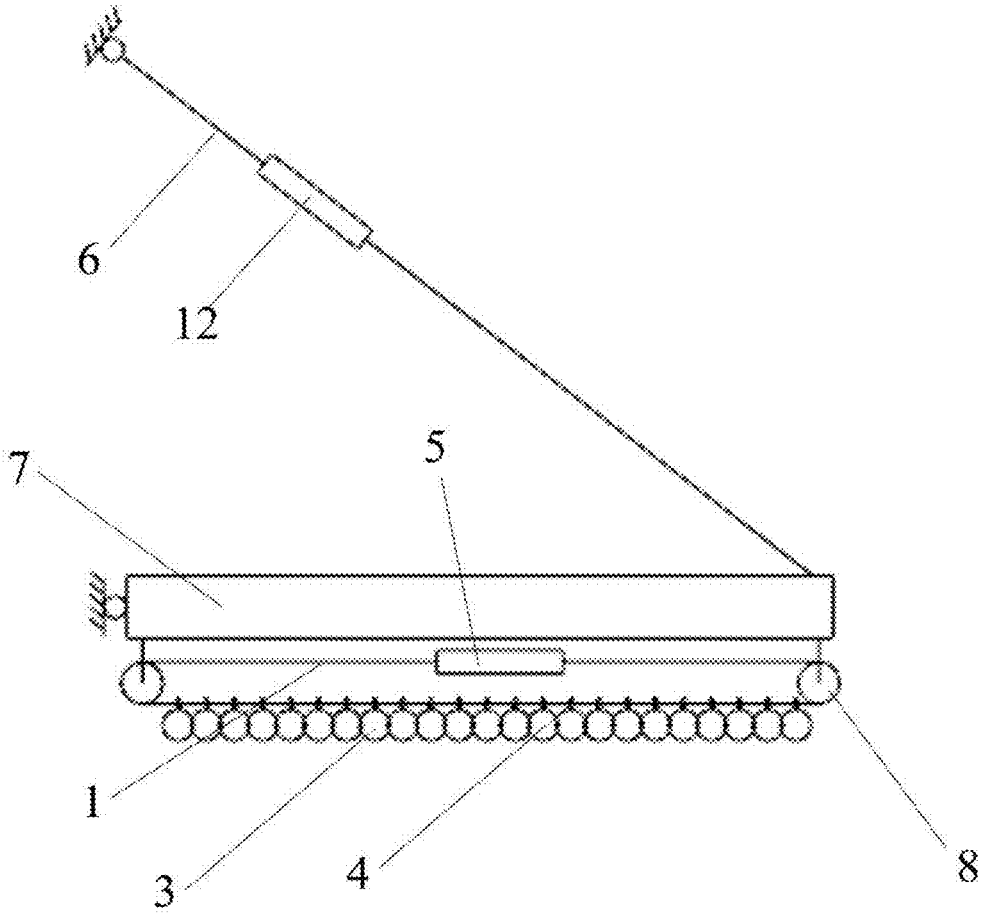
FIG. 3 is a side view of the modular unit of the present invention.

As shown in FIGS. 2-3, an expandable modular energy-dissipation protection net unit group is an independent energy-dissipation unit, which includes support columns 7 each provided at each of its two ends with a first horizontal longitudinal rotation reversing device 9 on the left side, a second horizontal longitudinal rotation reversing device 11 on the right side (the reference numeral 9 on the right side of the Figures is supposed to be 11) and a transverse rotation reversing device 8 on the bottom; a transverse endless support rope 1 wound on the transverse rotation reversing devices 8 located at two ends of the support column 7; a longitudinal endless support rope 2 wound on adjacent first and second horizontal longitudinal rotation reversing devices 9, 11; and connecting members 4 by which a metal net panel 3 is tied and hung on the transverse endless support rope and the longitudinal endless support rope. The metal net panel 3 is woven by steel wire ropes or steel wire rings.

The transverse endless support rope 1 and the longitudinal endless support rope 2 are each formed by a plurality of steel wire ropes in parallel, and include a side A at a lower side and a side B at an upper side. The connecting members 4 are tied and hung on the side A, and first energy dissipaters 5 are connected to the side B.

In an embodiment of this application, the expandable modular energy-dissipation protection net unit group further includes a stabilizing and anchoring steel wire rope 6 anchored on a slope surface at one end and connected to the support column 7 at the other end. The stabilizing and anchoring steel wire rope 6 is used to restrain the vertical swing of the support columns located in the middle of the system and the longitudinal swing and deformation of the support columns on both sides to ensure the stability of the system. Preferably, second energy dissipaters 12 are connected to the stabilizing and anchoring steel wire rope 6.

The first energy dissipaters 5 and second energy dissipaters 12 are traction energy dissipaters, and the energy-dissipation capacity, quantity and arrangement of the first and second energy dissipaters 5, 12 are adjustable. As an example, a yield energy dissipater, a friction energy dissipater or a spring buffer can be used, and both ends of the energy dissipater are connected to the endless support ropes.

The support columns 7 support the modular energy-dissipation units. Adjacent expandable modular units share one support column 7, and transmit the impact load to the slope surface protected. In an embodiment of the present application, the first horizontal longitudinal rotation reversing device 9, the second horizontal longitudinal rotation reversing device 11 and the transverse rotation reversing device 8 are fixed pulleys. Two ends of the support column 7 are respectively provided with three fixed pulleys, and specifically each end includes a transverse connecting fixed pulley 8 and a pair of two longitudinal connecting pulleys 9 and 11. The transverse connecting fixed pulley 8 is used for supporting the transverse endless support rope 1, and the pair of longitudinal connecting pulleys 9, 11 are used for connecting the longitudinal endless support ropes 2 within the modular unit group and the longitudinal endless support ropes 2 expanding and connecting adjacent modular units.

Figure 4:
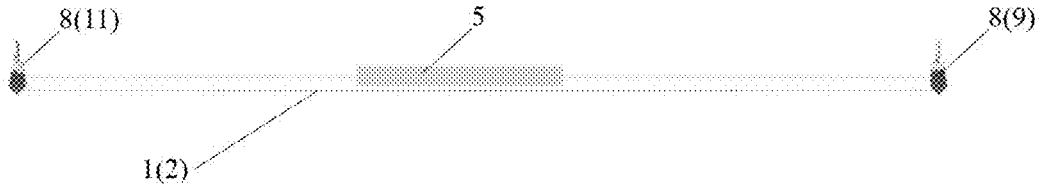
FIG. 4 is a schematic diagram of an endless support rope of the present invention.
Figure 5:
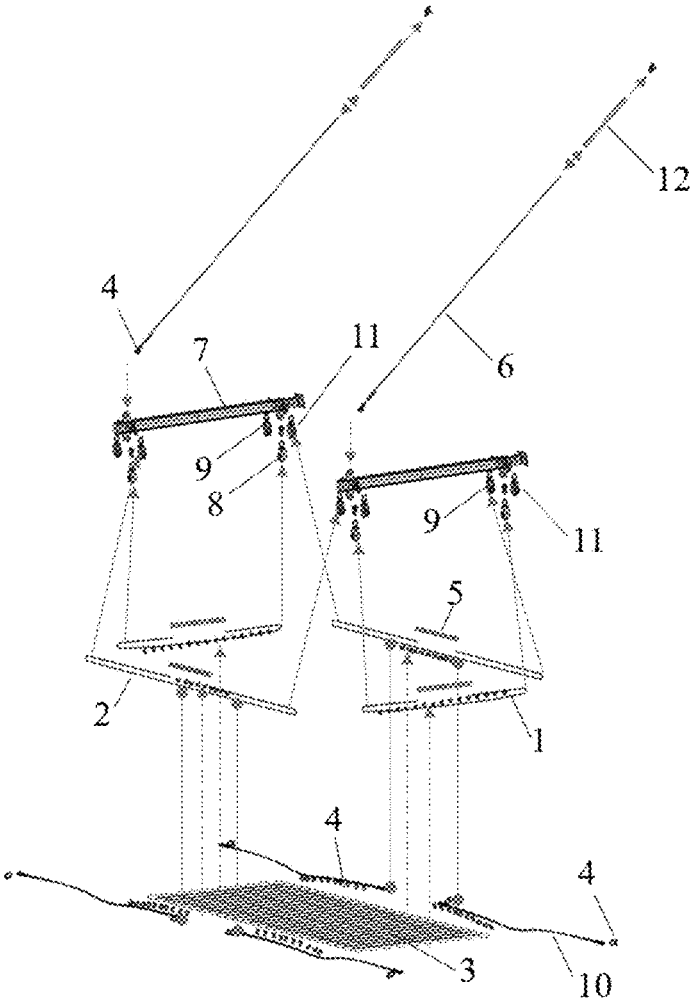
FIG. 5 is a schematic diagram showing installation of the modular units of the present invention.

In an embodiment of the present application, as shown in FIGS. 1, 4 and 5, a plurality of expandable modular unit groups as described above can be connected with each other to form a modular-unit uniformly-distributed energy-dissipation protection net system, wherein adjacent expandable modular unit groups share a support column 7. Specifically, the installation method of fabricated integration is as follows: the longitudinal endless support rope 2 of each independent energy-dissipation unit can be connected to the first and second horizontal longitudinal rotation reversing devices 9, 11 at two ends of the support columns to realize the arbitrary expansion of the modular energy-dissipation units.

Further, the modular-unit uniformly-distributed energy-dissipation protection net system further includes segmented longitudinal tethers 10, by which adjacent support columns 7 are connected to ensure the stability of the system.

An installation method of the modular-unit uniformly-distributed energy-dissipation protection net system of the present application includes the following construction steps:

a. foundation of support columns 7 is constructed according to an overall arrangement of the system, and then the support columns 7 are installed, wherein the support columns 7 may be laid flat on a slope surface with the bottom thereof hinged;

b. the horizontal longitudinal rotation reversing device 9, the second horizontal longitudinal rotation reversing device 11 and the transverse rotation reversing device 8 are installed at each of two ends of each support column 7;

c. steel wire ropes are made to pass around the horizontal longitudinal rotation reversing device 9, the second horizontal longitudinal rotation reversing device 11 and the transverse rotation reversing device 8, and then are connected to form a transverse endless support rope 1 and a longitudinal endless support rope 2 of a modular unit;

d. a metal net panel 3 of the modular unit is installed and is connected with the transverse endless support rope 1 and the longitudinal endless support rope 2 by connecting members 4;

e. segmented longitudinal tethers 10 between columns of modular units are installed;

f. stabilizing and anchoring steel wire ropes 6 for support columns 7 are installed without anchoring;

g. cable wind ropes for temporary construction are installed at the ends of the support columns 7, the support columns 7 are pulled up from the ground by pulling the cable wind ropes using a hoisting apparatus until bodies of the support columns 7 and the slope surface reach an inclination angle and posture specified by the design, and the system is temporarily fixed by the cable wind ropes;

h. the longitudinal tethers 10 are tensioned, and tensile steel wire ropes and the lateral stabilizing and anchoring steel wire ropes for the support columns 7 are tensioned and anchored on the ground; and i. the cable wind ropes for temporary fixing are removed to complete the installation.

When the metal net panel of the modular-unit uniformly-distributed energy-dissipation protection net system is stressed, the side A is dragged, the endless rope slides along the pair of fixed pulleys, and the traction energy dissipaters on the side B are stretched to apply work and dissipate energy. Each group of endless support ropes forms an independent closed energy-dissipation ring, which in turn forms a self-balancing and supporting relationship with the support columns without the need for ground anchoring.

In the modular-unit uniformly-distributed energy-dissipation protection net system of the present application, the metal net panel is tied and hung by endless support ropes arranged in vertical and horizontal directions between columns, which replace the longitudinal upper and lower support ropes pulled through integrally in the traditional passive net system, thus leading to a shortened sliding path and reduced tension loss of the longitudinal support ropes and improving the energy-dissipation capacity of the longitudinal support ropes; the energy dissipation of the endless support ropes functioning independently in each modular unit is limited within one energy-dissipation unit, and each modular unit dissipates energy independently and functions independently, thus avoiding associated damage of units between columns during operation of the pulled-through longitudinal support ropes in the traditional technology and improving the protection effect of the system; the energy-dissipation capacity of the units between columns is further improved by adding the transverse endless support rope; each unit of the system functions independently, which is convenient for replacement and maintenance, and avoids the problem of large-area damage caused by the strong correlation of the whole system during operation of the traditional protection net system; the energy-dissipation capacity of each modular unit can be arbitrarily combined to realize the non-segmented continuous construction of the flexible protection system, which solves the problem that the traditional protection net system must be set in segments, and the interception and protection length can be arbitrarily expanded according to the protection requirements; and by arranging the endless support ropes, anchor points arranged throughout the support ropes are greatly reduced, and the support ropes and the support columns in each modular unit form a self-balancing constraint, thus saving the material cost and reducing the construction difficulty.

Finally, it should be noted that the above embodiments are only intended to illustrate the technical solution of the present invention, rather than to limit it. Although the present invention has been described in detail with reference to the foregoing embodiments, it should be understood by those of ordinary skill in the art that modifications may still be made to the technical solutions described in the foregoing embodiments, or equivalent substitutions may be made for some of the technical features thereof. However, these modifications or substitutions do not make the essence of the corresponding technical solutions deviate from the spirit and scope of the technical solutions of each embodiment of the present invention.

The invention claimed is:

1. An expandable modular energy-dissipation protection net unit group, comprising:

a plurality of support columns, wherein each of two ends of each support column of the plurality of support columns is provided with a first horizontal longitudinal rotation reversing device on a left side, a second horizontal longitudinal rotation reversing device on a right side and a transverse rotation reversing device on a bottom;

a transverse endless support rope, wherein the transverse endless support rope is wound on the transverse rotation reversing device;

a longitudinal endless support rope, wherein the longitudinal endless support rope is wound on the first horizontal longitudinal rotation reversing device and the second horizontal longitudinal rotation reversing device adjacent; and a plurality of connecting members, wherein a metal net panel is tied by the plurality of connecting members and hung on the transverse endless support rope and the longitudinal endless support rope.

2. The expandable modular energy-dissipation protection net unit group according to claim 1, wherein the transverse endless support rope and the longitudinal endless support rope are each formed by a plurality of steel wire ropes in parallel and comprise a first side at a lower side and a second side at an upper side, the plurality of connecting members are tied and hung on the first side, and a plurality of first energy dissipaters are connected to the second side.

3. The expandable modular energy-dissipation protection net unit group according to claim 2, further comprising:

a stabilizing and anchoring steel wire rope, wherein a first end of the stabilizing and anchoring steel wire rope is anchored on a slope surface and a second end of the stabilizing and anchoring steel wire is connected to the support column of the plurality of support columns.

4. The expandable modular energy-dissipation protection net unit group according to claim 3, wherein a plurality of second energy dissipaters are connected to the stabilizing and anchoring steel wire rope.

5. The expandable modular energy-dissipation protection net unit group according to claim 4, wherein the plurality of first energy dissipaters and the plurality of second energy dissipaters are a plurality of traction energy dissipaters, and an energy-dissipation capacity, a quantity and an arrangement of the plurality of first energy dissipaters and the plurality of second energy dissipaters are adjustable.

6. The expandable modular energy-dissipation protection net unit group according to claim 4, wherein the horizontal longitudinal rotation reversing device, the second horizontal longitudinal rotation reversing device and the transverse rotation reversing device are fixed pulleys.

7. The modular-unit uniformly-distributed energy-dissipation protection net system, comprising a plurality of expandable modular unit groups according to claim 4, and a plurality of adjacent expandable modular unit groups share the same support column of the plurality of support columns.

8. The expandable modular energy-dissipation protection net unit group according to claim 3, wherein the horizontal longitudinal rotation reversing device, the second horizontal longitudinal rotation reversing device and the transverse rotation reversing device are fixed pulleys.

9. The modular-unit uniformly-distributed energy-dissipation protection net system, comprising a plurality of expandable modular unit groups according to claim 3, and a plurality of adjacent expandable modular unit groups share the same support column of the plurality of support columns.

10. The expandable modular energy-dissipation protection net unit group according to claim 2, wherein the metal net panel is woven by a plurality of steel wire ropes or a plurality of steel wire rings.

11. The expandable modular energy-dissipation protection net unit group according to claim 2, wherein the horizontal longitudinal rotation reversing device, the second horizontal longitudinal rotation reversing device and the transverse rotation reversing device are fixed pulleys.

12. The modular-unit uniformly-distributed energy-dissipation protection net system, comprising a plurality of expandable modular unit groups according to claim 2, and a plurality of adjacent expandable modular unit groups share the same support column of the plurality of support columns.

13. The expandable modular energy-dissipation protection net unit group according to claim 1, wherein the metal net panel is woven by a plurality of steel wire ropes or a plurality of steel wire rings.

14. The expandable modular energy-dissipation protection net unit group according to claim 13, wherein the horizontal longitudinal rotation reversing device, the second horizontal longitudinal rotation reversing device and the transverse rotation reversing device are fixed pulleys.

15. The modular-unit uniformly-distributed energy-dissipation protection net system, comprising a plurality of expandable modular unit groups according to claim 13, and a plurality of adjacent expandable modular unit groups share the same support column of the plurality of support columns.

16. The expandable modular energy-dissipation protection net unit group according to claim 1, wherein the horizontal longitudinal rotation reversing device, the second horizontal longitudinal rotation reversing device and the transverse rotation reversing device are fixed pulleys.

17. The modular-unit uniformly-distributed energy-dissipation protection net system, comprising a plurality of expandable modular unit groups according to claim 16, and a plurality of adjacent expandable modular unit groups share the same support column of the plurality of support columns.

18. A modular-unit uniformly-distributed energy-dissipation protection net system, comprising a plurality of expandable modular unit groups according to claim 1, and a plurality of adjacent expandable modular unit groups share the same support column of the plurality of support columns.

19. The modular-unit uniformly-distributed energy-dissipation protection net system according to claim 18, further comprising:

a plurality of segmented longitudinal tethers, wherein a plurality of adjacent support columns are connected by the plurality of segmented longitudinal tethers.

20. An installation method of the modular-unit uniformly-distributed energy-dissipation protection net system according to claim 19, comprising the following construction steps:

a) constructing a foundation of the plurality of support columns according to an overall arrangement of the modular-unit uniformly-distributed energy-dissipation protection net system, and then installing the plurality of support columns, wherein the plurality of support columns are laid flat on a slope surface with a bottom of the plurality of support columns hinged;

b) installing the horizontal longitudinal rotation reversing device, the second horizontal longitudinal rotation reversing device and the transverse rotation reversing device at the each of the two ends of the each support column of the plurality of support columns;

c) enabling a plurality of steel wire ropes to pass around the horizontal longitudinal rotation reversing device, the second horizontal longitudinal rotation reversing device and the transverse rotation reversing device, and connecting the plurality of steel wire ropes to form the transverse endless support rope and the longitudinal endless support rope of the expandable modular energy-dissipation protection net unit group;

d) installing the metal net panel of the expandable modular energy-dissipation protection net unit group and connecting the metal net panel to the transverse endless support rope and the longitudinal endless support rope by the plurality of connecting members;

e) installing the plurality of segmented longitudinal tethers between the plurality of support columns of the expandable modular energy-dissipation protection net unit group;

f) installing a plurality of stabilizing and anchoring steel wire ropes for the plurality of support columns without anchoring;

g) installing a plurality of cable wind ropes for a temporary construction at a plurality of ends of the plurality of support columns, pulling up the plurality of support columns from a ground by pulling the plurality of cable wind ropes using a hoisting apparatus until a plurality of bodies of the plurality of support columns and a slope surface reach an inclination angle and a posture specified by a design, and temporarily fixing the modular-unit uniformly-distributed energy-dissipation protection net system by the plurality of cable wind ropes;

h) tensioning the plurality of segmented longitudinal tethers, a plurality of tensile steel wire ropes and a plurality of lateral stabilizing and anchoring steel wire ropes for the plurality of support columns and anchoring the plurality of tensile steel wire ropes and the plurality of lateral stabilizing and anchoring steel wire ropes on the ground; and i) removing the plurality of cable wind ropes for a temporary fixing to complete an installation.

* * * * *